US010931007B2

(12) United States Patent
Roh et al.

(10) Patent No.: US 10,931,007 B2
(45) Date of Patent: Feb. 23, 2021

(54) ANTENNA MODULE, MANUFACTURING METHOD THEREOF, AND ELECTRONIC DEVICE INCLUDING THE ANTENNA MODULE

(71) Applicant: LG ELECTRONICS INC., Seoul (KR)

(72) Inventors: Woojoon Roh, Seoul (KR); Jihoon Hwang, Seoul (KR); Donghwi Son, Seoul (KR); Daeyong Seong, Seoul (KR); Byoungnam Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 32 days.

(21) Appl. No.: 16/287,769

(22) Filed: Feb. 27, 2019

(65) Prior Publication Data

US 2019/0393593 A1 Dec. 26, 2019

(30) Foreign Application Priority Data

Jun. 26, 2018 (KR) ..... 10-2018-0073526

(51) Int. Cl.
*H01Q 1/40* (2006.01)
*H01Q 1/36* (2006.01)
*H01Q 1/24* (2006.01)

(52) U.S. Cl.
CPC ..... *H01Q 1/40* (2013.01); *H01Q 1/243* (2013.01); *H01Q 1/364* (2013.01)

(58) Field of Classification Search
None
See application file for complete search history.

(56) References Cited

U.S. PATENT DOCUMENTS

| | | | | |
|---|---|---|---|---|
| 7,935,265 | B2 | 5/2011 | Schwanke et al. | |
| 8,586,178 | B2 | 11/2013 | Schwanke et al. | |
| 10,193,207 | B2 | 1/2019 | Ahn et al. | |
| 2006/0208949 | A1* | 9/2006 | Hirabayashi | H01Q 1/38 343/702 |
| 2011/0140971 | A1 | 6/2011 | Schwanke et al. | |
| 2013/0088406 | A1 | 4/2013 | Hamada et al. | |
| 2014/0203994 | A1* | 7/2014 | Hodono | H01Q 1/38 343/878 |
| 2017/0294700 | A1 | 10/2017 | Ahn et al. | |

FOREIGN PATENT DOCUMENTS

| | | | |
|---|---|---|---|
| JP | 2009-188895 | A | 8/2009 |
| JP | 2011-258609 | A | 12/2011 |
| KR | 10-2014-0031360 | A | 3/2014 |

* cited by examiner

*Primary Examiner* — Anh Q Tran
(74) *Attorney, Agent, or Firm* — Birch, Stewart, Kolasch & Birch, LLP

(57) ABSTRACT

Provided are an antenna module for 5G communication, a manufacturing method thereof, and an electronic device including the antenna module. The antenna module includes an antenna body having a space formed therein, a plated layer plated on an inner surface of the antenna body, and a pore member formed on an outer surface of the antenna body and having an dielectric constant lower than that of the antenna body, wherein a thickness of the antenna body is smaller than a thickness of the pore member.

19 Claims, 4 Drawing Sheets

FIG. 4

| DIELECTRIC CONSTANT | | | | | |
|---|---|---|---|---|---|
| FREQUENCY (GHz) | 2 | 6.1 | 10.2 | 14.4 | 18.6 |
| A-1 | 2.836371 | 2.835646 | 2.838277 | 2.841525 | 2.823214 |
| A-2 | 2.708887 | 2.703696 | 2.715359 | 2.733062 | 2.719983 |
| A-3 | 2.690822 | 2.688039 | 2.700885 | 2.718186 | 2.706532 |
| B-1 | 2.274951 | 2.297278 | 2.312988 | 2.324582 | 2.316556 |
| B-2 | 2.309853 | 2.313947 | 2.327644 | 2.339774 | 2.331525 |
| B-3 | 2.208694 | 2.234408 | 2.249698 | 2.260758 | 2.251426 |

ANTENNA MODULE, MANUFACTURING METHOD THEREOF, AND ELECTRONIC DEVICE INCLUDING THE ANTENNA MODULE

CROSS-REFERENCE TO RELATED APPLICATION

The present application claims priority under 35 U.S.C. 119 and 35 U.S.C. 365 to Korean Patent Application No. 10-2018-0073526, filed on Jun. 26, 2018 in the Korean Intellectual Property Office, the disclosure of which is hereby incorporated by reference in its entirety.

BACKGROUND OF THE INVENTION

Field of the Invention

The present disclosure relates to an antenna module, a manufacturing method thereof, and an electronic device including the antenna module, and more particularly, an antenna module optimized for 5G communication, a manufacturing method thereof, and an electronic device including the antenna module.

Description of the Related Art

Due to the recent development of communication technology, 5th Generation (5G) mobile telecommunication is expected to be commercialized.

5G has the feature that is 20 times faster than 4G LTE, has a delay time reduced from 0.02 seconds to 0.0001 seconds, and connects 1 million devices per 1 $km^2$.

4G uses a frequency below 2.6 GHz, while 5G uses a relatively high frequency above 3.5 GHz.

A conventional antenna module uses polycarbonate (PC) or polyethylene (PE) as a material of an outer cover. However, PC and PE are relatively high dielectric constant materials. Therefore, when PC or PE is directly used for an antenna of a 5G communication having a relatively high frequency, the performance of the antenna may be deteriorated.

Meanwhile, materials such as Teflon (PTFE) having a relatively low dielectric constant are relatively expensive, leading to an increase in manufacturing costs.

SUMMARY OF THE INVENTION

Embodiments are directed to provide an antenna module for use in 5G mobile communication using a relatively high frequency band, a manufacturing method thereof, and an electronic device including the antenna module.

An antenna module according to an embodiment of the present invention includes an antenna body having a space formed therein, a plated layer plated on an inner surface of the antenna body, and a pore member formed on an outer surface of the antenna body and having an dielectric constant lower than that of the antenna body, wherein a thickness of the antenna body is smaller than a thickness of the pore member.

The antenna module according to an embodiment of the present invention provides that a thickness of the plated layer is smaller than the thickness of the antenna body.

The antenna module according to an embodiment of the present invention provides that the thickness of the antenna body is approximately 0.1 times to approximately 0.8 times the thickness of the pore member.

The antenna module according to an embodiment of the present invention provides that the pore member is larger than the antenna body, and the pore member has at least one accommodation groove in which the antenna body is accommodated.

The antenna module according to an embodiment of the present invention provides that the accommodation groove includes a plurality of accommodation grooves spaced apart on the inner surface of the pore member.

The antenna module according to an embodiment of the present invention provides that a depth of the accommodation groove is 1/10 times to 1/2 times a maximum thickness of the pore member.

An electronic device according to an embodiment of the present invention includes an antenna module including an antenna body having a space formed therein, a plated layer plated on an inner surface of the antenna body, and a pore member formed on an outer surface of the antenna body and having an dielectric constant lower than that of the antenna body, wherein a thickness of the antenna body is smaller than a thickness of the pore member, a connector covering the space, and a coupling member connected to the plated layer and the connector and accommodated in the space.

The electronic device according to an embodiment of the present invention includes the connector including a plate, a PCB formed on a first surface of the plate and connected to the plated layer, and a connection member formed on a second surface of the plate and connected to an external device.

The electronic device according to an embodiment of the present invention provides that a coupling portion connected to the connector is formed around an opening surface of the antenna module, the coupling portion is in contact with the plate.

The electronic device according to an embodiment of the present invention provides that the pore member is at least one of a PC and a PE, the antenna body is an ABS, and the plated layer is at least one of gold, copper, and nickel.

A method for manufacturing an antenna module according to an embodiment of the present invention includes molding a pore member by foam injection, insert-injecting an antenna body on an inner surface of the pore member, the antenna body having a thickness smaller than that of the pore member and a dielectric constant higher than that of the pore member, and plating a plated layer on the antenna body.

The details of one or more embodiments are set forth in the accompanying drawings and the description below. Other features will be apparent from the description and drawings, and from the claims.

BRIEF DESCRIPTION OF THE DRAWINGS

FIG. 4 is experimental data showing an effect of reducing a dielectric constant of an antenna module according to an embodiment of the present disclosure.

DETAILED DESCRIPTION OF THE EMBODIMENTS

Hereinafter, embodiments relating to the present invention will be described in detail with reference to the accompanying drawings. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
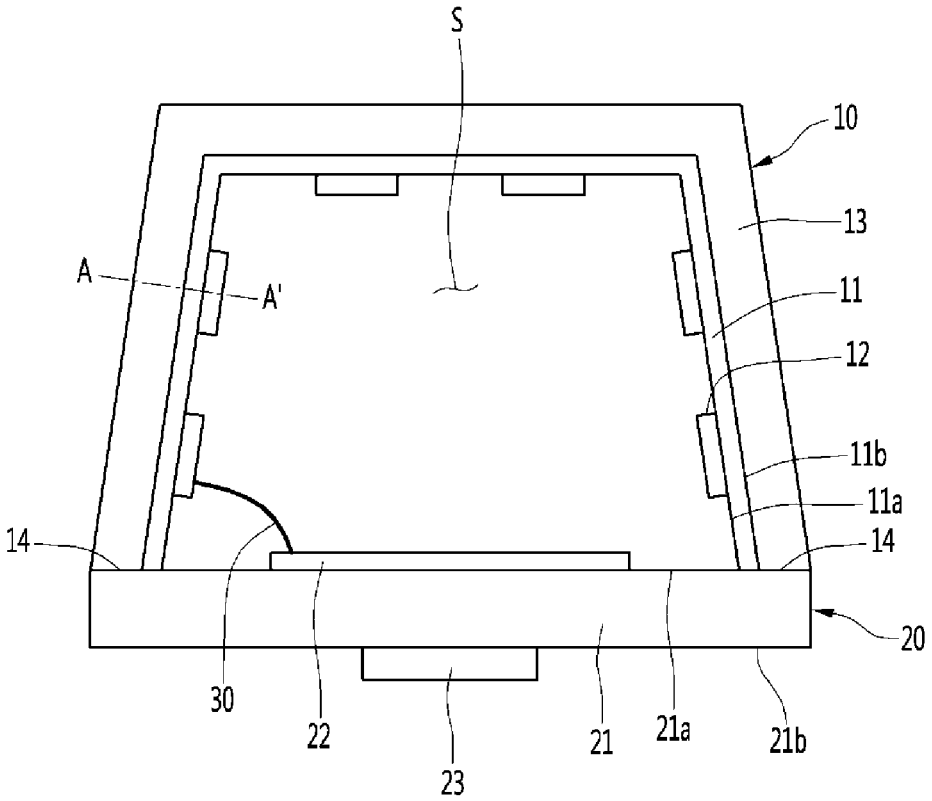
FIG. 1 is a horizontal cross-sectional view of an electronic device including an antenna module according to an embodiment of the present disclosure.
Figure 2:
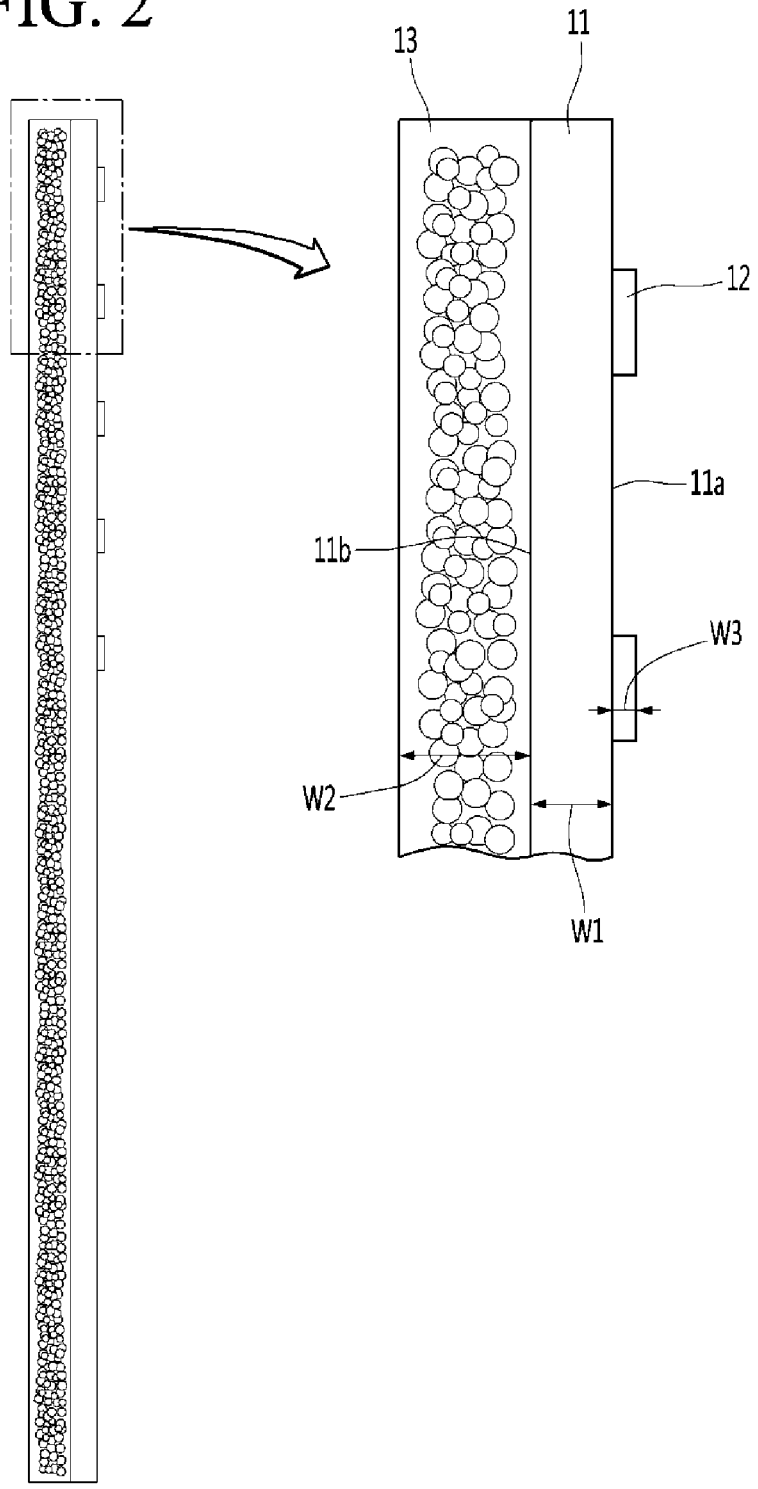
FIG. 2 is a cross-sectional view taken along line A-A' in FIG. 1 according to a first embodiment of the present disclosure.
Figure 3:
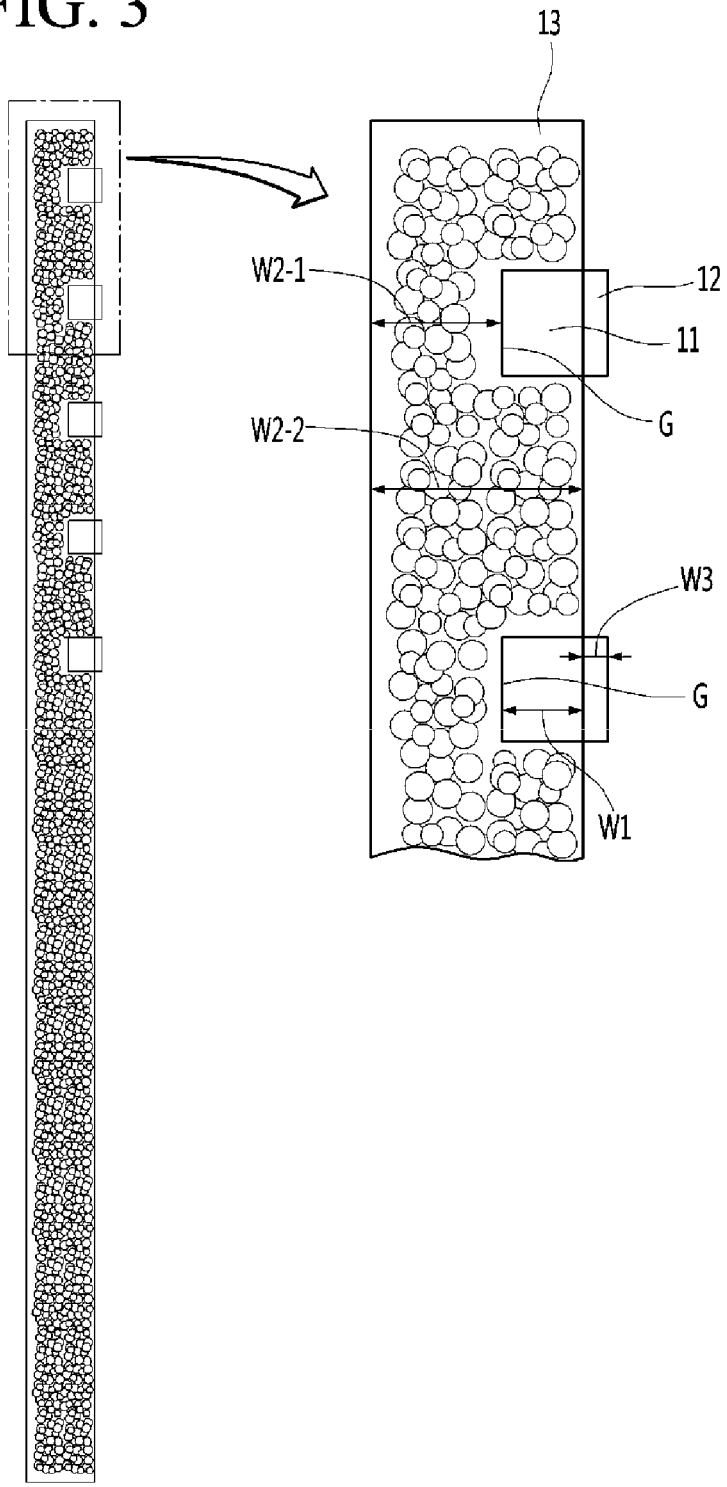
FIG. 3 is a cross-sectional view taken along line A-A' in FIG. 1 according to a second embodiment of the present disclosure.

Hereinafter, an antenna module, an electronic device including the antenna module, and a method for manufacturing the antenna module, according to embodiments of the present disclosure, will be described with reference to FIGS. 1 to 3, FIG. 1 is a horizontal cross-sectional view of an electronic device including an antenna module according to an embodiment of the present disclosure.

The electronic device including the antenna module according to the embodiment of the present disclosure may include an antenna module 10, a connector 20, and a connection member 30.

The antenna module 10 may transmit or receive an electromagnetic wave to or from a space in order for signal transmission and reception.

The antenna module 10 according to the embodiment of the present disclosure may include an antenna body 11 having a space S formed therein, a plated layer 12 plated on an inner surface 11*a* of the antenna body 11, and a pore member formed on an outer surface 11*b* of the antenna body 11.

In this instance, a dielectric constant of the pore member 13 may be lower than a dielectric constant of the antenna body 11, and a thickness of the antenna body 11 may be smaller than a thickness of the pore member 13. That is, the outside of the antenna module 10 may be formed of the pore member 13 having a relatively low dielectric constant. Therefore, a signal having a relatively high frequency band may easily pass through the antenna module 10.

The pore member 13 may be plastic having at least one pore formed therein. The size of the pore may be tens of μm to approximately 1 mm. For example, the size of the pore may be approximately 5 μm to approximately 500 μm, but is not particularly limited.

The pore member 13 may be a foam-molded material by putting a foaming agent in a plastic material so that bubbles are generated so as to become the pore or pores.

A foaming ratio of the pore member 13 at the time of foaming molding (or foam molding) is preferably 20%, but is not particularly limited.

According to an embodiment, $N_2$ and $CO_2$ are injected into a barrel portion of an injector, the injected gas is in one phase with a molten resin in a high temperature and high pressure state, a pressure is lowered while the molten resin moves to a mold, and a foaming process is performed inside the resin to thereby manufacture the pore member 13. That is, the pore member 13 may be manufactured according to a physical foaming molding method.

According to another embodiment, a resin material and a foaming agent are added to an injector hopper at an appropriate ratio, $CO_2$ gas is generated inside a barrel portion of an injector, but the gas and the resin molten at high temperature and high pressure become one phase, a pressure is lowered while the molten resin moves to a mold, and a foaming process is performed inside the resin to thereby manufacture the pore member 13. That is, the pore member 13 may be manufactured according to a chemical foaming molding method.

However, the manufacturing method of the pore member 13 described above is merely an illustrative example, and the pore member 13 may be manufactured by various methods.

As the density of the pore member 13 is reduced by the pores formed therein, the dielectric constant thereof may be reduced.

The pore member 13 may be at least one of polycarbonate (PC) and polyethylene (PE), but is not limited thereto. The pore member 13 may be at least one of polybutylene terephthalate (PBT), polypropylene (PP), acrylonitrile butadiene styrene copolymer (ABS), and polycarbonate/acrylonitrile butadiene styrene (PC/ABS), in addition to PC and PE.

According to an embodiment, the outer surface of the pore member 13 may be coated or colored.

The antenna body 11 is a platable resin and may be insert-injected into the pore member 13.

Since a plurality of pores are formed in the pore member 13, plating may not be easy. Therefore, the antenna module 10 according to the embodiment of the present disclosure may be manufactured by insert-injecting the antenna body 11 on the inner surface of the foam-injected pore member 13.

The antenna body 11 is preferably ABS, but this is merely an example. The antenna body 11 may include a platable resin.

The antenna body 11 may be formed to a minimum thickness enough to be plated. Specifically, the pore member 13 may become slightly thick due to the foam injection. Therefore, the antenna body 11 may be formed to have a thickness enough to be plated so that the total thickness of the antenna module 10 is not thickened, and may be formed as thin as possible.

For example, the thickness of the antenna body 11 may be approximately 0.1 times to approximately 0.6 times the thickness of the pore member 13.

The space S may be formed inside the antenna body 11.

The plated layer 12 may be formed on the inner surface 11*a* of the antenna body 11, and the plated layer 12 may be accommodated in the space S.

The plated layer 12 may be plated on the antenna body 11. The plated layer 12 may use at least one of gold, copper, and nickel as a conductive material, but is not particularly limited.

The plated layer 12 may form an antenna pattern.

The shape and method in which the plated layer 12 is formed on the antenna body 11 will be described with reference to FIGS. 2 and 3.

The thickness of the plated layer 12 may be smaller than the thickness of the antenna body 11. That is, the plated layer 12 in the antenna module 10 may be thinner than the antenna body 11, and the antenna body 11 may be thinner than the pore member 13.

The electronic device including the antenna module may further include the connector 20 and the connection member 30 in addition to the antenna module 10 described above.

The connector 20 may cover the space formed inside the antenna module 10 and simultaneously connect the antenna module 10 to another external device.

The antenna module 10 may have a polygonal shape, and one surface of the antenna module 10 may be opened. A coupling portion 14 connected to the connector 20 may be formed around an opening surface which is an opened surface of the antenna module 10.

The coupling portion 14 may be in contact with the connector 20, in particular, a plate 21 of the connector to be described below. The coupling portion 14 may be in contact with the plate 21 so that the connector 20 may cover the space S formed in the antenna module 10.

The connector 20 may include a plate 21, a printed circuit board (PCB) 22 formed on a first surface 21*a* of the plate 21 and connected to the plated layer 12, and a coupling member 23 formed on a second surface 21*b* of the plate 21 and connected to an external device.

The plate 21 may cover the space S. Therefore, it is possible to minimize air, moisture, or the like from being introduced in the space S, thereby minimizing the occurrence of corrosion in the plated layer 12. It is possible to minimize the damage to the plated layer 12 by minimizing the exposure of the space 2 to external friction or the like.

Meanwhile, the PCB 22 may be formed on the first surface 21*a* of the plate 21, and the first surface 21*a* may face the space S of the antenna module 10. Therefore, the PCB 22 may be accommodated in the space S and may be connected to the plated layer 12 by the connection member 30.

The connection member 30 may connect the plated layer 12 to the connector 20 and may connect the plated layer 12 to the PCB 22.

The PCB 22 may perform control so as to transmit signals to the external device connected to the coupling member 23 by transmitting signals to the outside through the plated layer 12 or receiving signals from the outside.

The coupling member 23 may be connected to the external device. The external device may include any electronic devices transmitting and receiving communication signals, such as a mobile phone, a vehicle, or a server.

Accordingly, the antenna module 10 may perform control such that signals transmitted and received by the electronic device connected through the connector 20 can be more efficiently transmitted and received.

According to an embodiment, the antenna body 11 may be insert-injected into the inner surface of the pore member 13, and the plated layer 12 may be plated on the antenna body 11.

In this instance, the antenna body 11 may be formed on all or part of the inner surface of the pore member 13. Specifically, according to a first embodiment of the present disclosure, the antenna body 11 may be formed on an entire inner surface of the pore member 13, and the plated layer 12 may be formed on a partial inner surface of the antenna body 11. Meanwhile, according to a second embodiment of the present disclosure, the antenna body 11 may be formed on a partial inner surface of the pore member 13, and the plated layer 12 may be formed on an entire inner surface of the antenna body 11.

FIG. 2 is a cross-sectional view taken along line A-A' in FIG. 1 according to a first embodiment of the present disclosure, and FIG. 3 is a cross-sectional view taken along line A-A' in FIG. 1 according to a second embodiment of the present disclosure.

First, referring to FIG. 2, according to the first embodiment of the present disclosure, the antenna body 11 may be insert-injected into the entire inner surface of the pore member 13. The plated layer 12 may be plated on at least part of the inner surface 11*a* of the antenna body 11.

In this instance, a region of the inner surface 11*a* of the antenna body 11 other than a region in which the plated layer 12 is to be formed may be plated after masking. Therefore, it is possible to prevent a region other than the region in which the plated layer 12 is to be formed from being plated in the antenna body 11.

A thickness W1 of the antenna body 11 may be smaller than a thickness W2 of the pore member 13 and may be larger than a thickness W3 of the plated layer 12.

According to the first embodiment of the present disclosure, the shape of the pore member 13 may be relatively simple, thereby facilitating the manufacturing.

Next, referring to FIG. 3, according to the second embodiment of the present disclosure, the pore member 13 may be larger than the antenna body 11. The pore member 13 may have at least one accommodation groove G at which the antenna body 11 is accommodated, and the antenna body 11 may be insert-injected into the accommodation groove G in the inner surface of the pore member 13.

The accommodation groove G may be a plurality of accommodation grooves. The plurality of accommodation grooves may be spaced apart on the inner surface of the pore member 13.

The pore member 13 may have a minimum thickness W2-1 in the region in which the accommodation groove G is formed, and may have a maximum thickness W2-2 in the region in which the accommodation groove G is not formed.

A depth of the accommodation groove G may be 1/10 times to ½ times the maximum thickness W2-2 of the pore member 13. However, these are merely an example, and the present disclosure is not limited thereto.

The thickness W1 of the antenna body 11 may be equal to the depth of the accommodation groove G.

Alternatively, the thickness W1 of the antenna body 11 may be smaller than or equal to a value obtained by subtracting the minimum thickness W2-1 from the maximum thickness W2-2 of the pore member 13.

The plated layer 12 may be plated on the inner surface of the antenna body 11.

According to the second embodiment of the present disclosure, the total thickness of the antenna module 10 may be minimized. That is, according to the second embodiment of the present disclosure, the total thickness of the antenna module 10 may be minimized by reducing the thickness of the region in which the antenna body 11 and the plated layer 12 are formed.

As described above, the antenna module 10 according to various embodiments of the present disclosure may be manufactured by a step of molding the pore member 13 through foam injection, a step of insert-injecting the antenna body 11 having a thickness smaller than that of the pore member 13 and a dielectric constant higher than that of the pore member 13 on the inner surface of the pore member 13, and a step of plating the plated layer 12 on the antenna body 11. Meanwhile, in the instance of a material which allows the plated layer 12 to be uniformly formed according to the material of the pore member 13, it is possible to manufacture the antenna module 10 in which the antenna body 11 is omitted.

As such, the antenna module 10, the electronic device including the antenna module 10, and the manufacturing method of the antenna module 10 can be applied to various electronic devices such as mobile phones, vehicles, repeaters disposed in a tall building or a basement, IoT-applied home appliances, robots, and drones.

Since the antenna module according to the embodiment of the present invention is manufactured as a single part having a multilayer, the assembling process may be reduced. Since the manufacturing process is simplified, the quality of the product may be increased and the manufacturing time may be reduced.

In addition, the antenna module according to the embodiment of the present disclosure uses a material (for example, PC or PE) having chemical resistance and weather resistance, and the dielectric constant is reduced through the pore member having pores formed therein. Therefore, the antenna performance may be secured and the manufacturing cost may be reduced.

FIG. 4 is experimental data showing an effect of reducing a dielectric constant of an antenna module according to an embodiment of the present disclosure.

Referring to FIG. 4, A-1, A-2, and A-3 show results obtained by measuring dielectric constants of injection-molded products having no pores, that is, general plastic injection-molded products with respect to various frequency bands.

Meanwhile, B-1, B-2, and B-3 in FIG. 4 show results obtained by measuring dielectric constants of pore members foam-injected to form pores therein with respect to various frequency bands.

It can be seen from FIG. 4 that the dielectric constants measured with respect to A-1, A-2, and A-3 are about 2.7 to about 2.8, and the dielectric constants measured with respect to B-1, B-2, and B-3 are about 2.2 to about 2.3. That is, it can be seen that the dielectric constant of the pore member is lower than the dielectric constant of the general plastic injection-molded product.

Therefore, since the outer appearance of the antenna module according to the present disclosure is formed of the pore member, the dielectric constant of the antenna module may be reduced, and the signal having a high frequency band may be easily transmitted and received, thereby improving the performance of the antenna module.

The antenna module, the electronic device including the antenna module, and the manufacturing method of the antenna module are not limited to the configurations and the methods of the above-described embodiments, all or part of the embodiments may be selectively combined so that various modifications can be made thereto.

According to embodiments, it is possible to minimize the deterioration in the performance of the antenna module which transmits and receives a communication signal having a relatively high frequency band through a pore member having a low dielectric constant.

According to embodiments, the antenna body has a minimum thickness enough to form a plated layer, and the plated layer also has a minimum thickness enough to serve as the pattern antenna, thereby minimizing the total thickness of the antenna module and reducing the weight to the maximum.

According to the embodiments, the connector is mounted so as to cover the opening surface of the antenna module, thereby minimizing the possibility of damage due to corrosion, friction, and the like of the plated layer.

The description above is merely illustrative of the technical idea of the present invention, and various changes and modifications may be made by those skilled in the art without departing from the essential characteristics of the present invention.

Therefore, the embodiments disclosed in the present invention are intended to illustrate rather than limit the scope of the present invention, and the scope of the technical idea of the present invention is not limited by these embodiments.

The scope of protection of the present invention should be construed according to the following claims, and all technical ideas within the scope of equivalents should be construed as being included in the scope of the present invention.

What is claimed is:

1. An antenna module comprising:
- an antenna body having a space formed therein;
- a plated layer plated on an inner surface of the antenna body; and
- a pore member formed on an outer surface of the antenna body and having a dielectric constant lower than that of the antenna body,
- wherein a thickness of the antenna body is smaller than a thickness of the pore member, and
- wherein the inner surface of the antenna body surrounds the space.

2. The antenna module according to claim 1, wherein a thickness of the plated layer is smaller than the thickness of the antenna body.

3. The antenna module according to claim 1, wherein the thickness of the antenna body is approximately 0.1 times to approximately 0.8 times the thickness of the pore member.

4. The antenna module according to claim 1, wherein the pore member is larger than the antenna body, and
- wherein the pore member has at least one accommodation groove in which the antenna body is accommodated.

5. The antenna module according to claim 4, wherein the accommodation groove comprises a plurality of accommodation grooves spaced apart on an inner surface of the pore member.

6. The antenna module according to claim 4, wherein a depth of the accommodation groove is approximately 1/10 times to approximately ½ times a maximum thickness of the pore member.

7. The antenna module according to claim 1, wherein the inner surface and the outer surface are opposite surfaces of the antenna body.

8. The antenna module according to claim 1, wherein the antenna body and the pore member are formed of resin materials.

9. An electronic device comprising:
- an antenna module comprising:
  - an antenna body having a space formed therein;
  - a plated layer plated on an inner surface of the antenna body; and
  - a pore member formed on an outer surface of the antenna body and having a dielectric constant lower than that of the antenna body, wherein a thickness of the antenna body is smaller than a thickness of the pore member;
- a connector covering the space; and
- a coupling member connected to the plated layer and the connector and accommodated in the space.

10. The electronic device according to claim 9, wherein the connector comprises:
- a plate;
- a printed circuit board (PCB) formed on a first surface of the plate and connected to the plated layer; and a connection member formed on a second surface of the plate and connected to an external device.

11. The electronic device according to claim 10, wherein a coupling portion connected to the connector is formed around an opening surface of the antenna module, and wherein the coupling portion is in contact with the plate.

12. The electronic device according to claim 9, wherein, the pore member is at least one of polycarbonate (PC) and polyethylene (PE), the antenna body is acrylonitrile butadiene styrene copolymer (ABS), and the plated layer is at least one of gold, copper, and nickel.

13. The electronic device according to claim 9, wherein the inner surface of the antenna body surrounds the space.

14. The antenna module according to claim 9, wherein the inner surface and the outer surface are opposite surfaces of the antenna body.

15. The antenna module according to claim 9, wherein the antenna body and the pore member are formed of resin materials.

16. A method for manufacturing an antenna module, the method comprising:

molding a pore member by foam injection;

insert-injecting an antenna body on an inner surface of the pore member, the antenna body having a thickness smaller than that of the pore member and a dielectric constant higher than that of the pore member; and plating a plated layer on the antenna body, wherein an inner surface of the antenna body surrounds a space.

17. The method according to claim 16, wherein the plated layer is on the inner surface of the antenna body.

18. The antenna module according to claim 16, wherein the antenna body is interposed between the plated layer and the pore member.

19. The method according to claim 16, wherein the antenna body and the pore member are formed of resin materials.

* * * * *